United States Patent [19]

Bartlett

[11] Patent Number: 4,966,016

[45] Date of Patent: Oct. 30, 1990

[54] CRYOPUMP WITH MULTIPLE REFRIGERATORS

[76] Inventor: Allen J. Bartlett, 10 Jillson Cir., Milford, Mass. 01757

[21] Appl. No.: 423,728

[22] Filed: Oct. 17, 1989

Related U.S. Application Data

[63] Continuation of Ser. No. 310,222, Feb. 13, 1989, abandoned, which is a continuation of Ser. No. 7,019, Jan. 27, 1987, abandoned.

[51] Int. Cl.[5] ..... B01D 8/00

[52] U.S. Cl. ..... 62/55.5; 62/268; 55/269; 417/901

[58] Field of Search ..... 62/55.5, 100, 268; 55/269; 417/901

[56] References Cited

U.S. PATENT DOCUMENTS

| | | | |
|---|---|---|---|
| 3,119,243 | 1/1964 | Hnilicka, Jr. et al. | 62/331 |
| 4,148,196 | 4/1979 | French et al. | 62/55.5 |
| 4,150,549 | 4/1979 | Longsworth | 62/55.5 |
| 4,240,262 | 12/1980 | Nakamura et al. | 62/55.5 |
| 4,311,018 | 1/1982 | Welch | 62/55.5 |
| 4,449,373 | 5/1984 | Peterson et al. | 62/55.5 |
| 4,584,839 | 4/1986 | Jensen et al. | 62/6 |

FOREIGN PATENT DOCUMENTS 58-131381 8/1983 Japan .

*Primary Examiner*—Ronald C. Capossela

*Attorney, Agent, or Firm*—Hamilton, Brook, Smith & Reynolds

[57] ABSTRACT

The present invention relates to a cryopump with multiple cooling sufaces, each cooled independently by a closed-cycle refrigerator. Specifically, a primary pumping surface is cooled by a first, two-stage refrigerator independently from the radiation shield, which is cooled by a second, single-stage refrigerator.

18 Claims, 2 Drawing Sheets

CRYOPUMP WITH MULTIPLE REFRIGERATORS

This is a continuation of co-pending application Ser. No. 07/310,222 filed on Feb. 13, 1989, which is a continuation of SN 07/007,019 filed on 1/27/87 (Now abandoned).

BACKGROUND OF THE INVENTION

Cryopumps currently available are typically used in equipment for the manufacture of integrated circuits and other electronic components, as well as for the deposition of thin films in a variety of consumer and industrial products. The utility of the cryopumps is to create a contaminant-free vacuum by freezing or pumping out gases in a work environment.

The design concept of these cryopumps are similar. The cryopumps comprise a low temperature surface called a primary pumping surface, which operates in the temperature range of 4 to 25K and a higher temperature surface, which operates in the temperature range of 70 to 130K. The higher temperature surface, often called a radiation shield, surrounds the primary pumping surface and provides radiation shielding and a pumping site for the higher boiling point gases. The spacing between the primary pumping surface and the radiation shield must be sufficient to permit unobstructed flow of low boiling temperature gases from a vacuum chamber to the primary pumping surface. Between the chamber to be evacuated and the low temperature surfaces is a frontal array, which also serves as a radiation shield for the primary pumping surface. The frontal array is typically cooled to 110 to 130K by thermally coupling it to the radiation shield.

In operation, high boiling point gases, such as water vapor, are condensed on the frontal array. Lower boiling point gases pass through that array and into a volume within the radiation shielding where they condense on the primary condensing surface. Often, an adsorbent, such as charcoal, is placed adjacent to, but shielded by, the primary condensing surface and is operated at the temperature of that surface to adsorb gases which have very low boiling point temperatures and are not condensed on the primary surface. With the gases thus condensed and/or adsorbed onto the pumping surfaces, only a vacuum remains.

The refrigerator used for cooling the pumping or adsorbent surfaces may be an open or closed cycled cryogenic refrigerator. The most common refrigerator used is a two-stage cold-finger, closed-cycle refrigerator. Typically, the cold end of the second stage, which is the coldest stage, is connected to the primary pumping surface. The first stage is connected to the radiation shield which surrounds the primary pumping surface.

DISCLOSURE OF THE INVENTION

The present invention relates to cryopumps having multiple closed-cycle refrigerators. This invention eliminates the temperature dependence associated with cooling both the radiation shield and primary pumping surfaces with a two-stage refrigerator. With a two-stage refrigerator, the second or colder temperature stage is dependent upon the first or warmer temperature stage. This is disadvantageous in a cryopump where you want to operate the radiation shield (first stage) at a high temperature, 110–130K, and the primary pumping surface (second stage) at a low temperature, 10–20K It is a primary objective of this invention to provide for independent cooling of the radiation shield and primary pumping surfaces.

A second objective is to improve the utility of the application of closed cycle coolers to cryopump designs. If more cooling capacity is needed for larger cryopumps which may be required for a new product, one or more additional standard refrigerators may be added to provide the increased cooling capacity The result is a reduction in cost and time for developing a single large refrigerator capable of handling the cooling capacity needed for that particular application. Thus, the present invention allows for new product lines requiring larger cryopumps to be easily accommodated with multiple refrigerators commonly available.

In one embodiment of the invention, a primary pumping surface is cooled by a closed-cycled, two-stage cold-finger refrigerator, independent from the cooling of a radiation shield. The radiation shield, which is separated from and surrounds the primary surface, is cooled by a closed-cycled, single-staged cold-finger refrigerator. Thus, the pumping surface temperatures are maintained independent of each other. Since the radiation shield requires the largest portion of the cooling capacity needed by the cryopump, multiple standard refrigeration devices may be added.

In a second embodiment, both the primary condensing surface and the radiation shield are cooled by a closed-cycled, two-staged cold-finger refrigerator. The primary pumping surface is cooled by the second stage, the coldest stage, of the refrigerator, while the radiation shield is cooled by the first stage of the refrigerator. A second closed-cycled, two-staged cold-finger refrigerator is used for independently cooling an adsorbent panel spaced from and surrounded by the primary condensing surface. Adsorption of the lowest boiling point gases is enhanced by operation at the coldest temperatures attainable.

BRIEF DESCRIPTION OF THE DRAWINGS

The foregoing and other objects, features, and advantages of the invention will be apparent from the following more particular description of the preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE INVENTION

Figure 1:
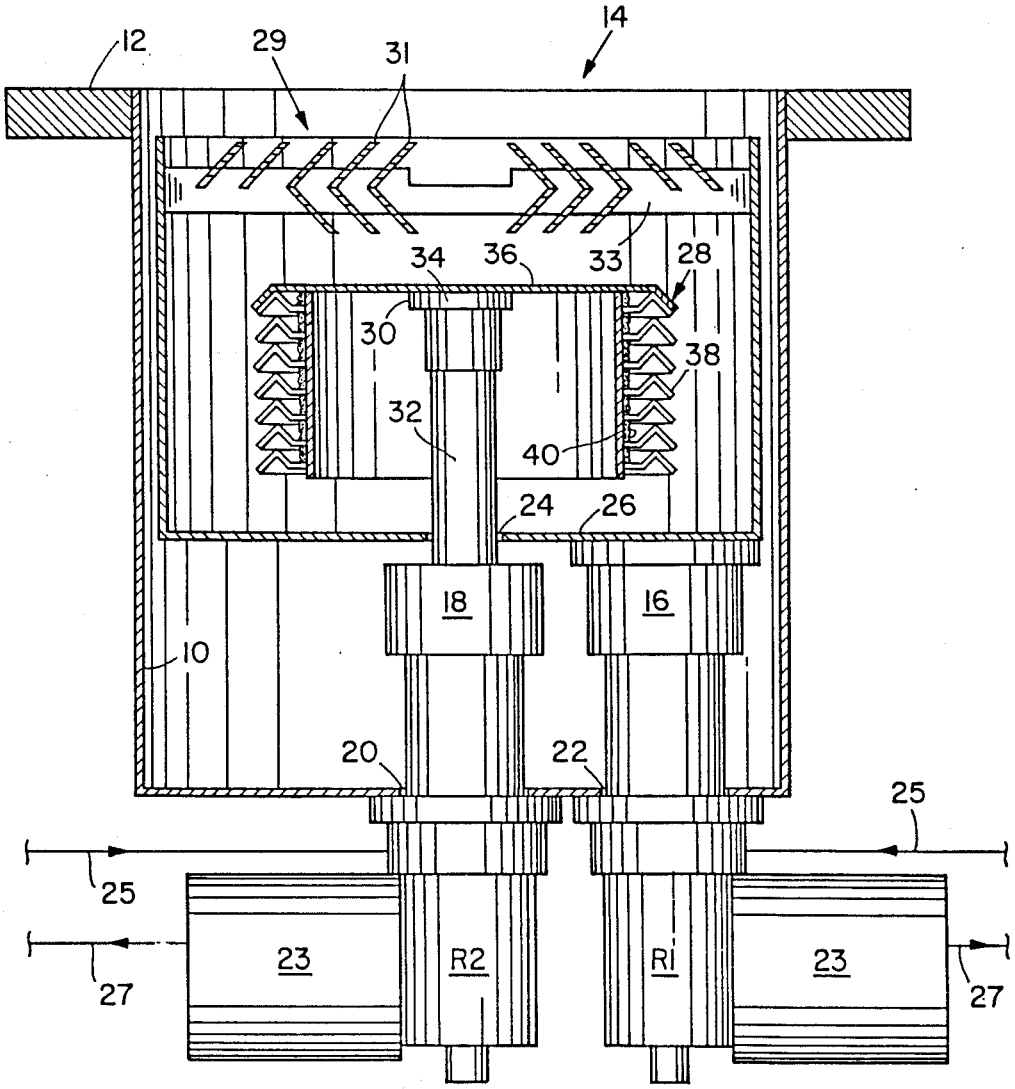
FIG. 1 is a partial cross sectional view of a cryopump with a two stage refrigerator used for cooling the primary pumping surface and a single stage refrigerator used for cooling the radiation shield.

The cryopump of FIG. 1 comprises a main housing 10 which is mounted to the wall of a work chamber (not shown) along a flange 12. A front opening 14 in that housing 10 communicates with a circular opening in the work chamber. A single-stage cold finger 16 of a refrigerator R1 and a two-stage cold finger 18 of a second refrigerator R2 extend into the housing 10 through openings 20, 22, and 24. In this case, each refrigerator is a Gifford-MacMahon refrigerator but other refrigerators may be used. In each refrigerator, a displacer in the cold finger is driven by a motor 23. With each cycle, helium gas introduced into the cold finger under pressure through a feed line 25 is expanded and thus cooled and then exhausted through a return line 27. Such a refrigerator is disclosed in U.S. Pat. No. 3,218,815 to Chellis et al.

The single stage 16 of the first refrigerators R1 is mounted to a cup shaped radiation shield 26. The radiation shield 26 surrounds a primary pumping surface 28 to form a high temperature heat sink for minimizing the heating of the primary surface 28 by radiation. The temperature of the radiation shield may range from 80K adjacent to the single stage 16 of the first refrigerator R1 to about 130K adjacent to the opening 14.

Mounted to the radiation shield adjacent to the front opening is a frontal cryopanel 29 which serves as both a radiation shield for the primary pumping surface and as a pumping or condensing surface for higher boiling temperature gases such as water vapor. This panel comprises a circular array of concentric louvers and chevrons 31 joined by spoke-like plates 33, as described in U.S. Pat. No. 4,454,722 to Allen J. Bartlett et al. The configuration of this cryopanel need not be confined to circular concentric components; but it should be so arranged as to act as a radiant heat shield and a higher temperature cryopumping panel while providing a path for lower boiling temperature gases to the primary pumping surfaces.

A cold end 30 of the second stage 32 of the two-stage cold finger of the second refrigerator R2 extends through the radiation shield 26 to a heat sink 34. The heat sink 34 comprises a disk 36 and a set of circular chevrons 38 mounted to the disk 36 in a vertical array. This heat sink forms the primary condensing surface of the cryopump. Along a cylindrical surface between the chevrons 38 of the primary condensing surface is a low temperature adsorbent 40 such as charcoal for adsorbing low boiling point gases such as hydrogen, helium, and neon. In order to effectively pump the low boiling point gases it is preferred that both the condensing surface and the adsorbent forming the primary pumping surface 28 be cooled to 8–10K.

In conventional cryopumps, the radiation shield is mounted to the first stage of a single refrigerator used to cool both the shield and the primary surface. The second stage is coupled to the primary pumping surface. In environments where the radiation heat load to the first stage of these cryopumps increases, the load carrying capacity of the second stage decreases. This results in dragging the primary pumping surface up to a warmer temperature which reduces the amount of low boiling point gases pumped.

With the present invention, the primary condensing surface and the adsorbent surface are cooled independently from the radiation shield 26. The first stage 18 of the two-stage refrigerator R2, which is not thermally coupled to the radiation shield 26, only serves to precool the gases that will be pumped by the primary surface 28. The radiation shield 26, which requires the largest power load for cooling, is independently cooled by the single-stage refrigerator R1 and may be accompanied by other single-stage devices to achieve the required cooling capacity. Thus, the present invention allows the power load for large cryopumps to be distributed among smaller commercially available refrigerators, rather than redesigning a larger refrigerator capable of handling the load. This invention also provides the advantages of reducing lead times and costs by providing commonality of parts for new products requiring larger cryopumps.

Figure 2:
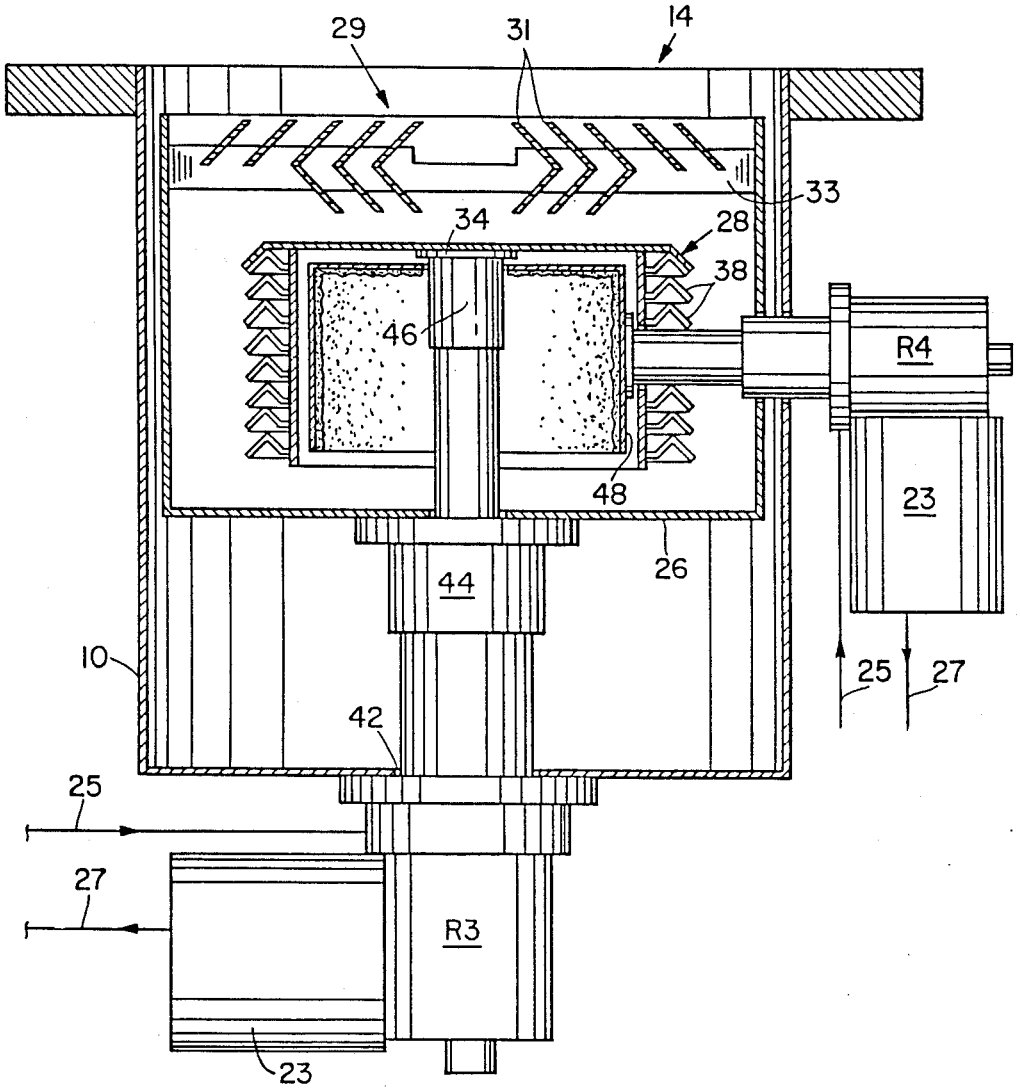
FIG. 2 is a partial cross sectional view of a cryopump with a two-stage refrigerator cooling the primary condensing surface and the radiation shield and a second two-stage refrigerator cooling an absorbent panel.

An alternate embodiment is shown in FIG. 2. As shown, a two-staged cold finger of closed-cycle refrigerator R3 extends into the housing 10 through an opening 42. Similar to conventional cryopumps, the first stage 44 is mounted to the radiation shield 26, and the cold end of the second stage 46 is mounted to the primary condensing surface 28. Unlike conventional cryopumps, however, a second refrigerator R4, preferably a two-staged, closed-cycle refrigerator, extends into the housing 10 and through both the radiation shield 26 and the primary condensing surface 28 to an adsorbent panel 48. The adsorent panel 48 is separate from and surrounded by the primary condensing surface 28. Thus, the adsorbent panel 48 is cooled independently from both the shield 26 and the primary condensing surface 28 which condense higher boiling point gases. With this arrangement, the primary condensing surface 28 can be cooled to temperatures such as 15–25K for effectively condensing gases and the adsorbent panel 48 can be independently cooled to temperatures such as 8–10K to absorb gases which were not condensed on the primary condensing surface.

While the invention has been particularly shown and described with reference to a preferred embodiment thereof, it will be understood by those skilled in the art that various changes in form and detail may be made therein without departing from the spirit and scope of the invention as defined by the appended claims. For example, various combinations of two-stage refrigerators and single stage refrigerators may be used to cool either the radiation shield, the primary condensing surface or the adsorbent panel.

I claim:

1. A cryopump comprising: first and second independently driven refrigerators each having a cold finger to separately control the temperature of a radiation shield and a primary pumping surface such that said shield is in thermal contact with, a cold end of the cold finger of the first refrigerator, and such that the primary pumping surface is spaced from and surrounded by the radiation shield, and is in thermal contact with the cold finger of the second refrigerator.

2. A cryopump as claimed in claim 1 wherein the first refrigerator is a closed cycle, single-stage refrigerator.

3. A cryopump as claimed in claim 1 wherein the second refrigerator is a closed cycle, two-stage refrigerator, the second stage, the coldest stage, in thermal contact with the primary pumping surface.

4. A cryopump comprising:

a radiation shield in thermal contact with the first stage of a first closed cycle, two-stage refrigerator;

a primary condensing surface, spaced from and surrounded by the radiation shield, in thermal contact with the second, coldest stage of the first closed-cycle, two-stage refrigerator;

an adsorber panel spaced from and surrounded by the primary condensing surface and in thermal contact with the second coldest stage of a second closed-cycle, two-stage refrigerator such that the second refrigerator operates independently from the first refrigerator.

5. A cryopump having multiple refrigerators comprising:

an adsorbent panel;

a first refrigerator for cooling the adsorbent panel;

a pumping surface spaced from and surrounding the adsorbent panel; and a second refrigerator for cooling the pumping surface independently from the adsorbent panel.

6. A cryopump having multiple refrigerators as claimed in claim 5 further comprising a primary condensing surface in thermal contact with the adsorbent panel.

7. A cryopump having multiple refrigerators as claimed in claim 6 wherein the first refrigerator is a closed-cycle, two-stage cold finger refrigerator.

8. A cryopump having multiple refrigerators as claimed in claim 5 wherein the pumping surface is a radiation shield spaced from and surrounding the primary condensing surface.

9. A cryopump having multiple refrigerators as claimed in claim 8 wherein the second refrigerator is a closed-cycle, single-stage cold finger refrigerator.

10. A cryopump having multiple refrigerators as claimed in claim 5 wherein the first refrigerator is a closed-cycle, single-stage, cold-finger refrigerator.

11. A cryopump having multiple refrigerators as claimed in claim 10 wherein:

the first refrigerator is a closed-cycle, two-stage cold finger refrigerator; and the cooling surface comprises a primary condensing surface cooled by the second stage, the coldest stage, of the two-stage refrigerator, and a radiation shield spaced from and surrounding the primary pumping surface cooled by the first stage of the two-stage refrigerator.

12. A cryopump adapted to be mounted to a chamber to be evacuated, the cryopump comprising:

a primary cooling surface within the chamber;

a first refrigerator for cooling the primary cooling surface;

a secondary cooling surface within the chamber that is spaced from and surrounds the primary cooling surface; and a second refrigerator for cooling the secondary cooling surface independently from the primary cooling surface.

13. A cryopump adapted to be mounted to a chamber to be evacuated as claimed in claim 12 wherein the secondary cooling surface is a radiation shield separate from and surrounding the primary cooling surface.

14. A cryopump adapted to be mounted to a chamber to be evacuated as claimed in claim 13 wherein the first refrigerator is a two-stage closed cycle refrigerator, the second stage, the coldest stage, extending through an opening in the radiation shield and in thermal contact with the primary cooling surface.

15. A cryopump adapted to be mounted to a chamber to be evacuated as claimed in claim 13 wherein the second refrigerator is a single-stage closed-cycle refrigerator having a cold finger in thermal contact with the radiation shield.

16. A cryopump adapted to be mounted to a chamber to be evacuated as claimed in claim 12 wherein the secondary cooling surface is an adsorber surface for adsorbing gases not condensed by the primary cooling surface.

17. A cryopump adapted to be mounted to a chamber to be evacuated as claimed in claim 16 wherein the second refrigerator is a two-stage, closed-cycle refrigerator, the second stage, the coldest stage, extending through an opening in the primary cooling surface and in thermal contact with the adsorber surface.

18. A cryopump adapted to be mounted to a chamber to be evacuated as claimed in claim 12, wherein the secondary cooling surface contacts only a cold end of a cold finger of the second refrigerator.

* * * * *